United States Patent [19]

Cedenblad et al.

[11] Patent Number: 4,572,370

[45] Date of Patent: Feb. 25, 1986

[54] PACKAGE FOR COILED PRODUCTS AND METHOD OF PRODUCTION THEREOF

[76] Inventors: Björn Cedenblad, Ligustervägen 11; Hans Alexandersson, Kaprifolvägen 5, both of S-513 00 Fristad, Sweden

[21] Appl. No.: 662,412

[22] PCT Filed: Jan. 26, 1984

[86] PCT No.: PCT/SE84/00024

§ 371 Date: Sep. 21, 1984

§ 102(e) Date: Sep. 21, 1984

[87] PCT Pub. No.: WO84/02893

PCT Pub. Date: Aug. 2, 1984

[30] Foreign Application Priority Data

Jan. 26, 1983 [SE] Sweden ..... 8300383

[51] Int. Cl.[4] ..... B65D 85/60

[52] U.S. Cl. ..... 206/398; 206/53; 206/408

[58] Field of Search ..... 206/303, 392, 389, 398, 206/401, 402, 53, 408

[56] References Cited

U.S. PATENT DOCUMENTS

| | | | |
|---|---|---|---|
| 2,943,732 | 7/1960 | Kovaleski et al. | 206/303 |
| 3,446,419 | 5/1969 | Mueller | 206/303 |
| 3,524,538 | 8/1970 | Marlowe | 206/303 |
| 3,729,092 | 4/1973 | Marcell | 206/303 |
| 3,910,409 | 10/1975 | Fortlage | 206/303 |
| 4,174,778 | 11/1979 | Klomp et al. | 206/303 |
| 4,513,864 | 4/1985 | Liebel | 206/303 |

*Primary Examiner*—Joseph Man-Fu Moy

[57] ABSTRACT

A package for products to be coiled such as ropes, hoses, cables, flexible tubing and similar kinds of products which are available by the yard coiled into a ring-shaped bundle (1). The package according to the invention comprises a supporting carrying construction (2) mounted on one side of the ring-shaped bundle (1). The supporting construction (2) can comprise an inner annular flat slab (3) the inside diameter of which essentially corresponds to the inside diameter of the ring-shaped bundle (1), and an outer (4) flat slab engaging the inner slab (3). The outer slab has a circular opening, the diameter of which is somewhat smaller than the outside diameter of the inner slab (3). The inner slab (3) is disposed concentrically with the circular opening of the outer slab (4) which it overlaps. To the outer slab (45) and the inner slab (3) a number of flexible bands (5) are fixed which extend outwards from the outer slab and inwards from the inner slab and which are of such length, that the bands (5A, 5B) after having been bent over the ring-shaped bundle (1) and fixed to one another, surround and retain the ring-shaped bundle (1) in cooperation with the supporting construction (2). The invention also relates to a method for manufacturing said package. According to the method the supporting construction (2) is disposed at one end of a rotatable coiling matrix perpendicularly to the rotation axis thereof. The product to be coiled is coiled on the matrix in close proximity to the supporting construction, and when a sufficient length has been coiled, the free ends (5A, 5B) of the band (5) are bent around the ring-shaped bundle thus formed and are clamped at one another on the opposite side of the bundle. The ring-shaped bundle can then be removed from the matrix as a package ready for delivery.

16 Claims, 12 Drawing Figures

PACKAGE FOR COILED PRODUCTS AND METHOD OF PRODUCTION THEREOF

The present invention relates to a package for coiled products such as ropes, hoses, flexible tubing, cables and similar kinds of products which are available by the yard coiled into ring-shaped bundles, as well as to a method of manufacturing such packages.

Products of said kind are usually manufactured in endless lengths, e.g. by extrusion, twisting or some analogous method of production. As the finished product is fed out it is coiled on to a rotating coiling drum, reel or winder in a number of juxtaposed windings and in a number of superposed layers such that a ring-shaped bundle is shaped, the dimensions and weight of which are adjusted for enabling comfortable handling of the finished package. When the bundle shaped by coiling has reached the set dimensions the feed out and coiling are stopped whereupon the coiled strands are fixed in position in relation to one another by tightening a strap or applying a strong adhesive piece of tape, e.g. plastic tape, wrapping and tying a string or the like across the coil direction, around the ring section of the ring-shaped bundle at spaced apart positions along the ring-shaped bundle. The coiled product may then be cut and the ring-shaped bundle removed from the coiling drum or reel in the shape of a ring-shaped, form stable bundle containing the intended quantity of the coiled product. The bundle can then be delivered in this condition to the consumer place such as a building storehouse, a workshop or some other kind of working place where various lengths of the product are to be used.

Before a certain set length of the product can be drawn from the bundle the cord, tape or string fixing the bundle must be cut. This will result in the ring-shaped bundle getting looser. The strands coiled up in ring-shape will no longer be held together which may result in that the bundle expands and consequently requires more space. One may also risk tangling the coiled strands and rendering renewed dispensing of a desired length more difficult.

It is the object of the present invention to eliminate said drawbacks and it thus relates to a package for coiled products which will not only ensure required rigidity in the products coiled up into a ring-shaped bundle in order to enable the handing a transportation of the bundle as a rigid unit, but which will also allow the dispensing of required lengths of the product from the bundle without impairing said rigidity. It is a further object of the invention to provide a package of said kind which is simple in construction and which can consequently be manufactured at a low cost. Still another object of the invention is to provide a package of said kind which is simple to use and which also permits refeeding into the package of an excessive length of the product drawn from the package. Another object of the invention is to provide a package which is rigid enough to permit the rolling of the package as a wheel over a bedding simultaneously as the product is being fed out from the package, e.g. when laying out tubing or cable.

It is also an object of the invention to provide a method of production of said package which permits the manufacture thereof in immediate connection with the coiling of the product at the place of its manufacture.

The objects mentioned above are achieved by providing an embodiment according to the characteristics and measures defined in the appended claims.

The invention will be described below with respect to two different examples of embodiment illustrated in the accompanying drawings in which FIG. 1 is a perspective view of a first embodiment of the finished package containing a set number of windings of the coiled product in the shape of a ring-shaped bundle, FIG. 2 is a perspective view illustrating the drawing out of a length of the product from the package shown in FIG. 1, FIG. 3 shows a front view of the simple components of which the package according to FIG. 1 is essentially constructed, FIG. 4 is a cross section through the parts of the package shown in FIG. 3, FIG. 5A and 5B as well as FIGS. 6—9 illustrate in an utterly schematic manner the various process-steps in the method according to the invention of manufacturing the package according to FIGS. 1—4.

Figure 1:
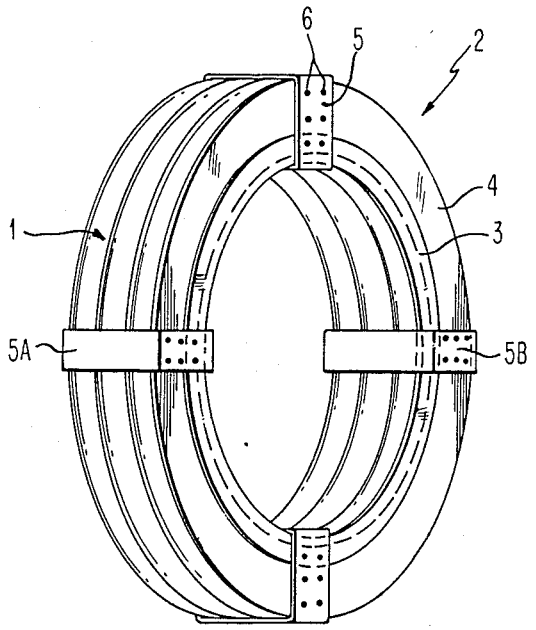

The embodiment of the package illustrated in FIGS. 1–5 comprises a rigid supporting construction 2 disposed on one side of a ring-shaped bundle 1 of coiled products such as hoses, flexible tubing, cables etc. Said supporting construction 2 comprises two interacting annular and essentially flat slabs made of a rigid but light material. The slabs 3, 4 can thus be cut out from a fibre board, a plastic sheet or else be constructed of wood or similar materials. The inner annular slab 3 has an inside diameter essentially corresponding to the inside diameter of the ring-shaped bundle formed by the coiled product. The outer slab 4, preferably also being annular, is internally formed with a circular opening, the diameter of which is somewhat smaller than the outside diameter or the inner annular slab 3, such that said slab 3 can be brought to engage the outer slab 4 with overlap. As particularly appears from FIG. 3 the outer slab 4 and the inner slab 3 are fixed in relation to one another by means of a number of bands 5 of which there are four in the shown preferred embodiment, said bands being attached both to the outer slab 4 and to the inner slab 3 in a suitable manner, e.g. by means of a screw joint, rivet joint, adhesive joint or by glueing. The bands 5 which are made of flexible material of a strength sufficient to keep the strands included in the bundle rigidly tightened together, after said bands having been bent around the ring-shaped bundle and fixed to one another, project initially partly outwards from the outer slab 4 with a strand 5A and partly inwards from the inner slab 3 with a strand 5B. Said strands 5A and 5B are of sufficient length to overlap one another after having been bent around the ring-shaped bundle to enable fixing to one another by riveting, stapling, glueing or by means of Velcro tape or the like. The bands 5 may consist of plastic tape, glass-fibre reinforced plastic bands, bands of textile or strong paper or cardboard. The bands 5 may also be made of elastic material, e.g. rubber material. As particularly appears from FIG. 1 the bands are folded around the ring-shaped bundle, the bands 5, on the side of the bundle opposite the slabs 3, 4 being fixed to one another e.g. by riveting or stapling, as indicated by the reference 7 in FIGS. 8 and 9.

Figure 2:
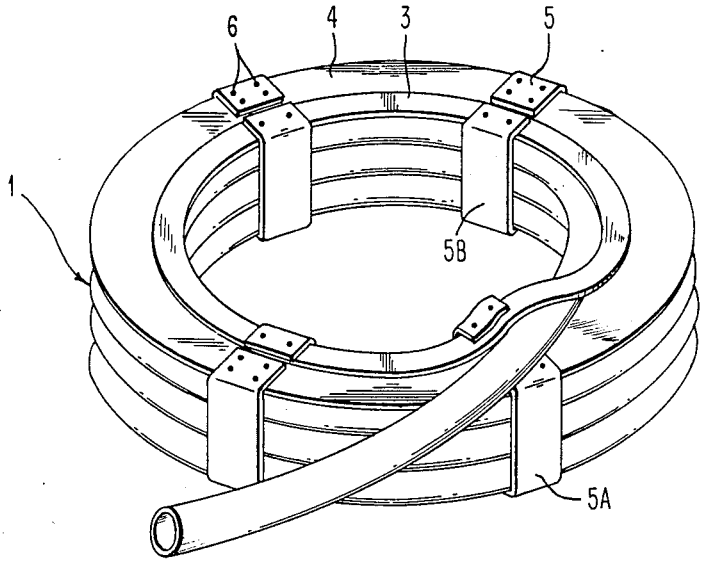
Figure 3:
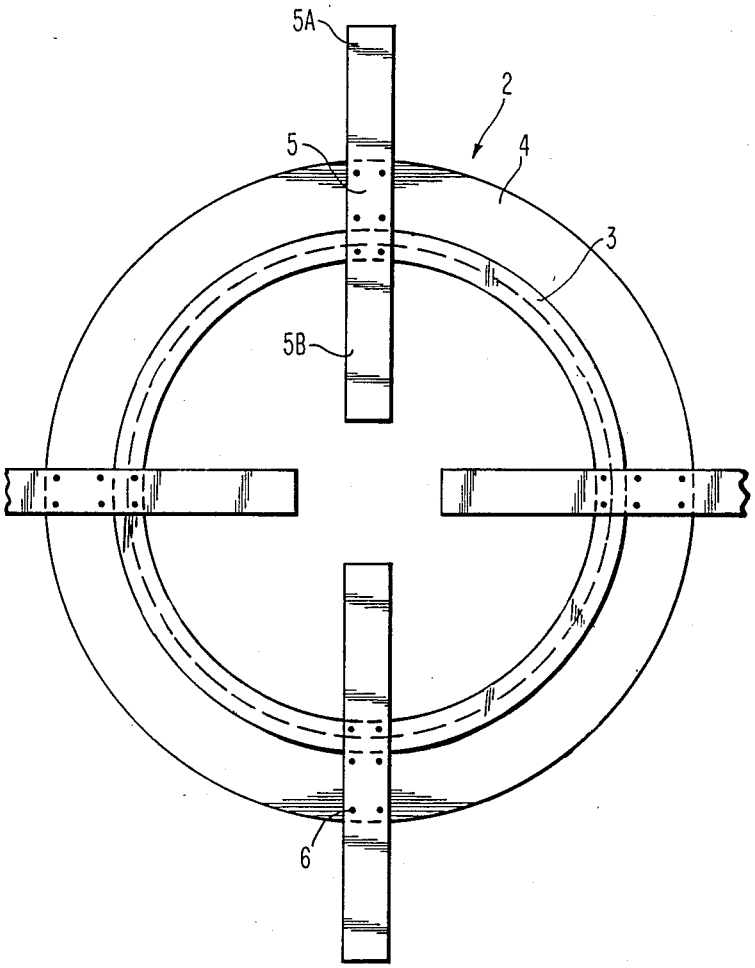
Figure 4:
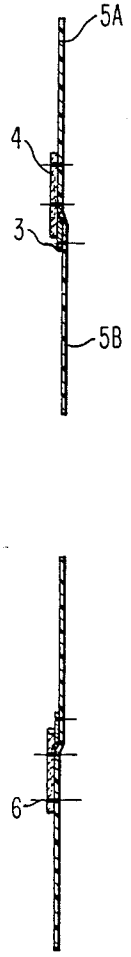

As particularly appears from FIGS. 1 and 2 the finished package will form a stable and rigid ring-shaped bundle which can easily be handled and transported from the place where it is packaged to the place where it is to be consumed, which may be a building storehouse, a workshop, or some other place of work where a required length of the coiled product is to be used.

FIG. 2 illustrates the taking out the coiled product from the package. The package is here shown resting on a horizontal bedding with the supporting construction consisting of the annular slabs 3 and 4 being turned upwards. When a set length of the product which may be e.g. hose of a certain dimension is to be taken out, first the bands 5 are cut at the position where the annular slabs 3 and 4 overlap one another. Then, in proximity to the inner end of the coiled hose the inner slab 3 is raised from the outer s1ab 4 to an adequate degree to permit the hose to be passed out between the inner slab 3 and the outer slab 4. The hose can then be uncoiled counter-clockwise and in this process is guided along the outside diameter of the annular inner slab 3. When a sufficient length has been uncoiled, the hose is cut. Should an excessive length have been uncoiled this excess length can be easily recoiled through the interspace between the annular inner slab 3 and the outer slab 4. It is obvious that the package aecording to the invention will keep the shape of the ring-shaped bundle essentially intact when the hose in being uncoiled and will prevent the bundle from expanding or tangling of the coiled layers. In FIG. 2 the package is shown as resting on a horizontal bedding but this is not a prerequisite for taking the product out from the package. It is thus expedient to place the package in vertical position e.g. hung on a wall where the package will occupy minimum space which may be particularly advantageous in premises of restricted space, e.g. building storehouses and the like. Packages of various dimensions of e.g. hose or flexible tubing are suitably given such a dimension that the inside diameter of the package of the largest dimension will correspond with some clearance to the outside diameter of the package of the next lower dimension such that the packages can be hung on a wall with the packages disposed inside one another with the largest hose or tube dimension outermost and the smaller dimensions innermost. By providing the carrying construction built from the annular slabs with sufficient rigidity the package can also be used for laying out e.g. flexible tubing or cable and can then be rolled along the intended laying-out distance.

In the embodiment shown in FIGS. 1–5 the annular inner slab 3 is clamped to the outer slab 4 by riveting, stapling, screwing, glueing etc. the bands 5 to the outer slab 4 as well as to the inner slab 3 with the band ends 5A and 5B projecting each in its direction from the annular slabs. Even if this is a preferred embodiment the band 5, however, can comprise two separate bands of which one engages the outer slab 4 projecting out therefrom and the other one engages the inner slab 3 projecting inwards therefrom. It is, however, a disadvantage of the latter embodiment that when the slabs are positioned against the ring-shaped bundle 1 it is essential that the slabs be centered in relation to one another such that they will overlap one another with a suitable degree of overlapping. Once the band ends 5A and 5B are fixed to one another on the opposite side of the ring-shaped bundle, the bands are kept in a centered position in relation to one another.

In the embodiment shown in FIGS. 1–5 the coiled product is uncoiled starting from the inside of the bundle. In order to facilitate this the radial width of the inner slab 3 is substantially smaller than the corresponding width of the outer slab. The outer slab 4 then also immediately engages one side of the bundle whereas the inner slab 3 engaging the outer slab on the side thereof turning away from the ring-shaped bundle. The package may also be formed, however, to allow uncoiling of the coiled product starting from the outside of the bundle. The package is then modified to the respect that the annular inner slab is given a substantially larger radial width than the corresponding width of the outer slab 4. The inner slab 3 will then also directly engage the outer side of the tube-shaped bundle, the annular outer slab 4 instead being made to overlap the inner slab on the side thereof turning away from the ring-shaped bundle.

In the embodiment according to FIGS. 1–5 the inner slab 3 as well as the outer slab 4 have a circular annular shape. It is no prerequisite, however, for the invention that the outer slab 4 be of a circular outward shape, but it may very well be of another shape, e.g. square-shaped. The inner slab 3, however, must always have a circular annular shape and the opening in the outer slab 4 must also be circular.

Figure 8:
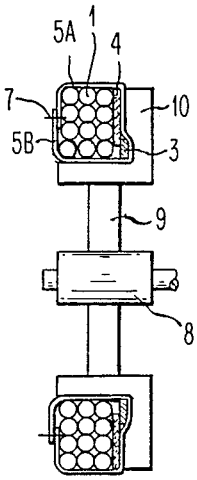
Figure 9:
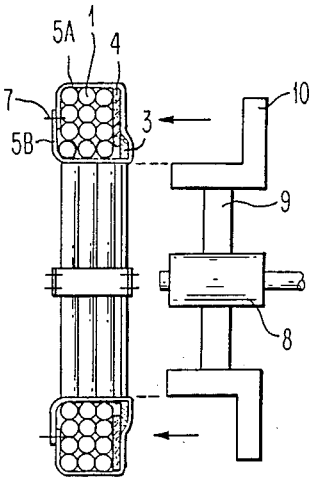

As already pointed out the package according to FIGS. 1–5 is advantageous in so far as it is conveniently produced in immediate connection with the manufacture of the products to be coiled and the invention also relates to a preferred method of manufacture of the package as will be schematically illustrated with reference to FIGS. 5A, 8–9.

Figure 5A:
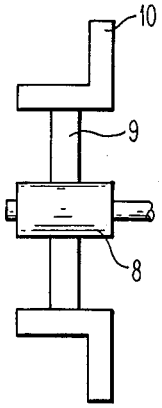
Figure 5B:
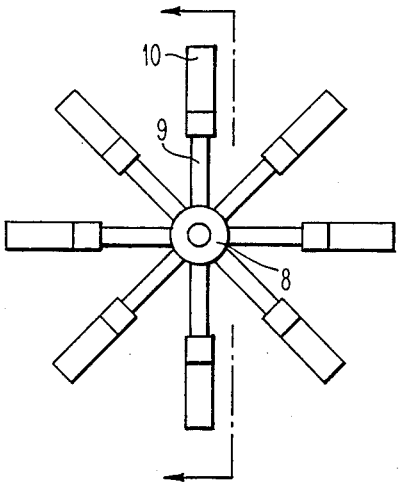

FIGS. 5A and 5B illustrate in an utterly schematic manner a coiling drum or reel which may be of any prior art type but which is shown to include a hub 8 with spikes 9 projecting radially from the hub and each carrying angular supporting means 10 together forming a cylindrical coiling matrix when rotated. The coiling drum or reel is preferably motor powered for rotation at a periphery speed corresponding to the feed-out speed of the product to be coiled.

Figure 6:
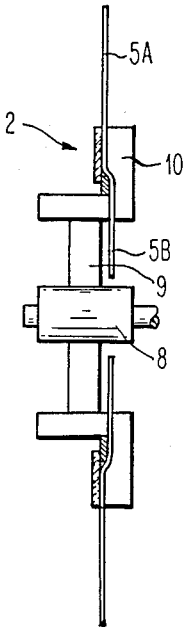

Before the coiling of the product on to the drum or reel is started the carrying construction 2 included in the package is placed on the coiling matrix at one end thereof and in a plane which is perpendicular to the axis of rotation of the coiling matrix. As will appear from the schematical FIG. 6 the outer slab 4 and the inner slab 3, clamped by means of the bands 5, are placed on the coiling matrix, the inner annular slab 3 engaging the vertical legs of the angular carrying means 10 of the coiling matrix, the bands 5 disposed on the side of the slabs 3 and 4 facing said angular means 10 and the band ends 5A projecting out from the outer slab and the band ends 5B projecting inwards from the inner slab 3.

Figure 7:
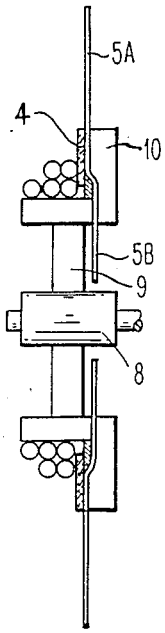

The end of the fed-out product intended for coiling is then clamped in any convenient manner to the coiling matrix in proximity to the supporting construction 2 placed thereon. The coiling drum or reel is then made to rotate at a periphery speed of the product being fed out. The coiling is performed with a predetermined number of juxtaposed strands and a predetermined number of superposed layers as illustrated schematically in FIGS. 7 and 8. When the predeterminated length has been coiled the coiling is stopped, whereupon the bands 5A and 5B are bent around the ring-shaped bundle, and, in this process, are brought to overlap one another after which the band ends 5A and 5B are clamped to one another by riveting as indicated by the reference number 7 in FIGS. 8 and 9 or by glueing or by means of so called Velcro tape, or in some other suitable manner.

After the band ends 5A and 5B have been folded around the ring-shaped bundle and clamped to one another, the finished package is removed from the coiling drum or reel, whereupon the supporting construction 2 for a new package is placed on the coiling matrix and the coiling process described above is repeated.

Figure 10:
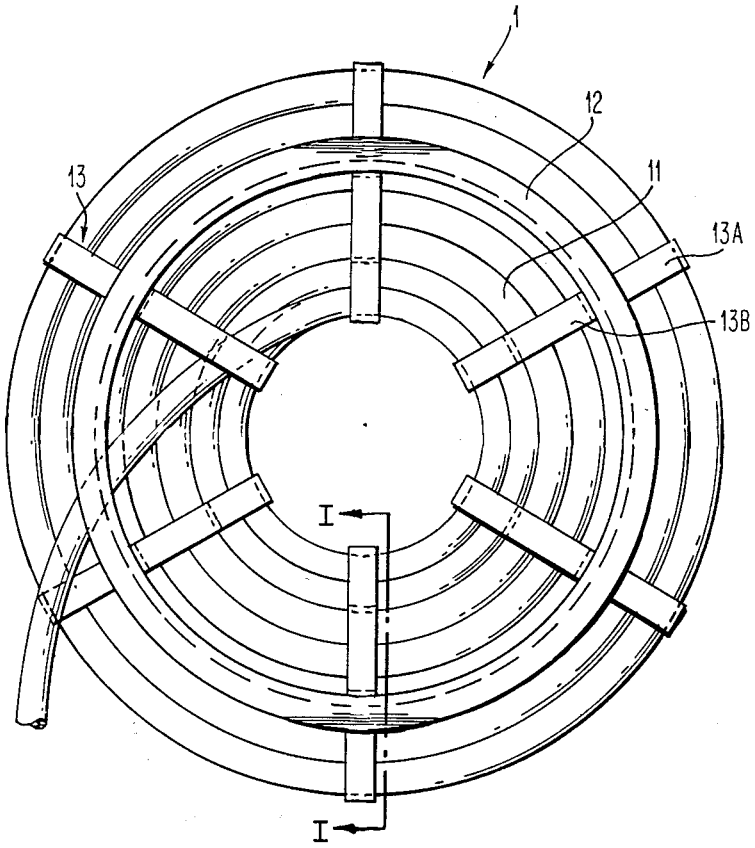
FIG. 10 is a plan view of a second embodiment of the package according to the invention.
Figure 11:
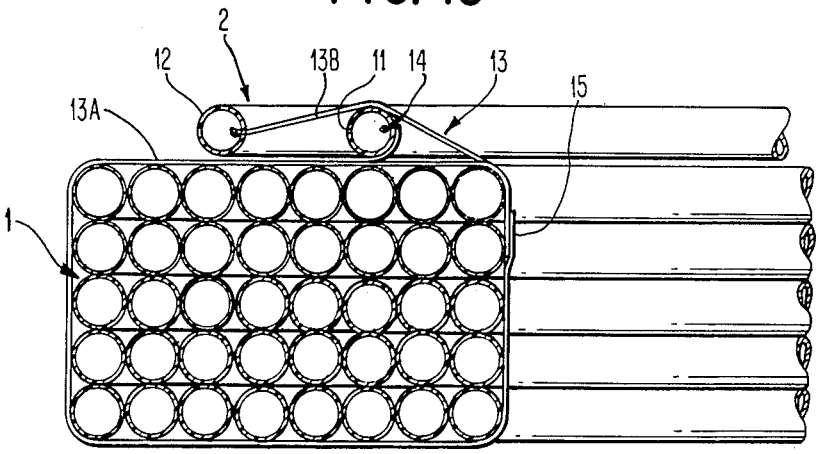
FIG. 11 is a partial section through the package shown in FIG. 10 taken as shown at I—I in FIG. 10.

In FIGS. 10 and 11 a variant of the package according to the invention is illustrated which is particularly well suited for use when the coiled products are in the form of e.g. flexible tubing, such as plastic tubing having relatively coarse dimensions. As in the variant described in connection with FIGS. 1–5 the package according to FIGS. 10 and 11 includes a rigid supporting construction 2 which is disposed on one side of a ring-shaped bundle 1 of coiled products, preferably flexible plastic tubing. On one side of the ring-shaped bundle 1 a supporting construction 2 is disposed comprising two juxtaposed substantially concentrically disposed annular supporting members, the inner annular supporting member 11 and the outer annular supporting member 12. The supporting members 11 and 12 thus form circular rings and are conveniently manufactured from tubing which has been bent into annular shape, preferably plastic tubing. The annular supporting members 11, 12 are mutually fixed to one another at least at three points along the periphery of the annular supporting members. The connection between the supporting members 11, 12 consists of flexible members and preferably comprises flexible bands 13, e.g. strong plastic bands, glass fibre reinforced plastic bands etc. One end of the band 13 is clamped to the inner annular supporting member, as shown at 14 in FIG. 11. The clamping can be achieved by riveting or screw-fixing the band 13, or the band end can be inserted through an opening in the tubular supporting member 11 and be locked on the inside of the tubular profile by means of a bead or the like. The band 13 then extends radially outwards along the upper side of the ring-shaped bundle 1, but underneath the outer annular supporting member 12. The band 13 then extends around the peripheral cross section of the bundle 1, back up over the inner annular supporting member 11 and, with its other end, is clamped to the outer supporting member 12. The clamping of the band to the supporting member 12 is conveniently performed in the same manner as the clamping to the inner annular supporting member 11. The band 13 is suitably divided into two parts 13A and 13B, one part 13A with one of its ends being clamped to the inner annular supporting member 11, and the other part 13B with its end being clamped to the outer annular supporting member 12, the bands portions 13A, 13B being attached to one another by means of a suitable locking device 15 of a prior art construction, e.g. of the type bulldog grip or stretcher, which partly connects the band portion 13A, 13B to one another and partly enables tightening of the sling which the band 13 forms in mounted condition. The number of band slings 13 should, as already mentioned, be at least three, evenly spaced along the periphery of the annular bundle, but suitably the number of band slings 13 should exceed this number, e.g. six band slings, as shown in FIG. 10.

The supporting construction 2 is mounted on the ring-shaped bundle 1 by disposing the inner annular supporting member 11 and the outer annular supporting member 12 on one side of the ring-shaped bundle 1 and orienting them substantially concentrically in relation on one another as well as in relation to the ring-shaped bundle 1. The band portions 13A, 13B are then arranged around the peripheral cross section of the ring-shaped bundle 1 and are connected to one another by means of the band stretcher 15, whereupon the band 13 is tightened by means of the band stretcher 15. The ring-shaped bundle 1 is then ready to be delivered to place of work or some other place of consumption.

When a required length of tubing is to be taken out from the bundle 1 the inner free end of the tubing in the bundle is moved up over the inner annular supporting member 11, whereupon the outer annular supporting member 12, which is movable perpendicularly to the level of the supporting members, is lifted to a sufficient degree in order to permit the tubing to be passed under the outer annular supporting member 12 and out from the ring-shaped bundle 1 as illustrated in FIG. 10. The desired length of tubing can be taken out from the ring-shaped bundle 1 by "uncoiling" the tubing from the inner of the ring-shaped bundle, according to FIG. 10 in clock-wise direction. If the ring-shaped bundle e.g. rests on a rotatable stand a corresponding effect can be achieved by pulling out the tubing end passed under the outer annular supporting member 12, the ring-shaped bundle being caused to rotate on its stand in counter clock-wise direction according to FIG. 10. The outer and inner annular supporting members 11 and 12 together with the bands 13 will ensure throughout the process that the ring-shaped bundle is kept at a desirable rigidity. After a sufficient number of coiled layers have been uncoiled from the package the band slings 13 are suitably tightened by means of the band stretchers 15.

In the preferred embodiment illustrated in FIGS. 10 and 11 the inner ring 11 and the outer ring 12 are radially spaced. They are spaced in such a manner that the tubing to be fed out can be conveniently passed down into the interspace and below the raised outer annular member 12. Even if the embodiment shown in FIGS. 10 and 11 where one annular member, the outer ring 12, is disposed radially outside the other annular member, the inner ring 11, the concept of the invention may also be applied by superposing the rings, provided that said rings are of a dimension that will not allow them to be passed through one another. The outside diameter of the superposed ring must therefore exceed the inside diameter of the underlying ring. In the example of embodiment shown in FIGS. 10 and 11 the length of tubing is uncoiled radially from within and outwards. It is obvious, however, that this order may be reversed so that the uncoiling is instead performed from the outside periphery and inwards. The only change required in so doing, as compared with the embodiment according to FIG. 11 being that the band 13 from its attachment in the annular member 12 is pulled radially, below the annular member 11 and then around the peripheral cross section of the ring-shaped package and back radially inwards over the annular member 11 to be clamped to the annular member 11. The embodiment according to the invention shown in FIGS. 10 and 11 has proved, as already noted, to be particularly expedient in bundles of tubing containing coarse and heavy plastic tubing and is furthermore advantageous owing to its simplicity of construction.

The invention as described above with reference to the examples of embodiment shown in the drawings is not limited to these embodiments but may be varied within the

We claim:

1. A package for products to be coiled, such as ropes, hoses, cables, flexible tubing, or similar products which are avaliable by the yard coiled into a ring-shaped bundle comprising a supporting carrying member disposed on one side of said ring-shaped bundle having two juxtaposed, essentially concentrically disposed annular supporting members, the outside diameter of one of the annular supporting members exceeding the inside diameter of the other annular supporting member, such that the two annular supporting members are connected with one another in at least three points along the periphery of said annular supporting members by means of a flexible member, said flexible members being partly clamped to one annular supporting member, and partly to the other annular supporting member and surrounding between said clamping points the peripheral cross section of the ring-shaped bundle, one of the two annular supporting members being disposed to allow sufficient movement in relation to the other annular supporting member substantially perpendicular to the level of said members whereby flexible tubing or the like included in the ring-shaped bundle can be passed between the two annular supporting members over one and under the other supporting member, or inversely.

2. A package according to claim 1, wherein said supporting members comprise an inner annular flat slab, the inside diameter of which substantially corresponds to the inside diameter of said ring-shaped bundle, and an outer flat slab engaging the inner slab and formed with a circular opening, the diameter of which is somewhat smaller than the outside diameter of the annular inner slab, the inner slab being disposed concentrically around the circular opening of the outer slab which it overlaps, a plurality of flexible outer bands evenly spaced and extending radially from the outer slab being fixed to the outer slab, said flexible inner bands extending inwards from the inner slab being fixed to the inner slab opposite each of said outer bands, whereby said outer and inner bands after having been bent around the ring-shaped bundle and fixed to one another surround and retain said ring-shaped bundle of coiled products in cooperation with said outer and inner slabs.

3. A package according to claim 2, wherein both the outer and the inner slab are annular in shape, the outside diameter of the outer slab substantially corresponding to the intended outside diameter of the ring-shaped bundle of coiled products.

4. A package according to claim 3, wherein the cross sectional width of the outer slab is substantially larger, from about twice to three times larger, than the cross sectional width of the inner slab and the inner slab overlaps the outer slab on the side thereof opposed to the ring-shaped bundle.

5. A package according to claim 3, wherein the cross sectional width of the inner slab is substantially larger, from about twice to three times larger, than the cross sectional width of the outer slab and the inner slab overlaps the outer slab on the side thereof facing the ring-shaped bundle.

6. A package according to any one of claims 2–5, wherein said outer and inner bands are disposed on a side of the outer or inner slab opposed to the ring-shaped bundle.

7. A package according to claim 2, wherein the pair of bands formed by an outer and an inner band comprises a continuous band which is fixed partly to the outer slab and partly to the inner slab, thereby fixing the slabs in relation to one another.

8. A package according to claim 7, wherein the length of the bands outside the respective slab is adjusted such that the band ends are brought to overlap one another after having been bent around the ring-shaped bundle.

9. A package according to claim 2, wherein said ban-shaped, flexible members are selected from the group consisting of plastic bands, fiber reinforced plastic bands, textile bands, rubber bands, paper bands and cardboard bands which are fixed to the outer or inner slab by means of rivet joints, stapling, glue joints, or the like.

10. A package according to claim 4 wherein the bands are fixed to one another by means of Velcro tape.

11. A package according to claim 1, wherein said supporting members comprise an inner annular supporting member and an outer annular supporting member substantially concentrically disposed around the inner supporting member, the inner annular supporting member being connected to the outer annular supporting member by means of flexible bands.

12. A package according to claim 11, wherein said flexible band at one end thereof is fixed to the inner annular supporting member and thence extends radially outwards below the outer annular supporting member and around the peripheral cross section of the ring-shaped bundle and over the inner annular supporting member and at its other end is clamped to the outer annular supporting member.

13. A package according to claim 11, wherein said flexible band at one end thereof is clamped to the outer annular supporting member and thence extends radially inwards under the inner ring-shaped supporting member, and around the peripheral cross section of the ring-shaped bundle and over the outer ring-shaped supporting member, and at its other end is fixed to the inner annular supporting member.

14. A package according to any one of claims 11–13, wherein the supporting members include two tube-shaped profiles bent to form circular rings, said tube-shaped profiles being tubing having a circular cross section.

15. A package according to claim 2, wherein each of said flexible bands is provided with a band stretcher for enabling the band to be tightened or slackened.

16. A method for producing a package for coiled products such as ropes, hoses, cables, flexible tubing and similar products which are available by the yard coiled into a ring-shaped bundle, comprising:

providing a supporting member having two flat annular slabs engaging one another in overlapping relationship and having flexible bands projecting outwardly and inwardly, respectively, from the slabs, and mounted on a rotatable coiling drum at one end thereof and perpendicularly to the rotation axis thereof, said coiling drum having supporting members parallel to the rotation axis and supported by legs, said supporting members forming a substantially cylindrical coiling matrix when rotated;

coiling said product by rotating the coiling drum to form a number of layers axially as well as radially on the coiling matrix, such that a ring-shaped bundle is formed;

bending said flexible bands over the ring-shaped bundle thus formed and attaching the same to one another on the side of the ring-shaped bundle opposed to said supporting member;

holding the bundle together by means of said bands; and removing the supporting member from the coiling matrix of the coiling drum to produce a coiled package ready to be distributed.

* * * * *